US005575299A

United States Patent [19]

Bieri

[11] Patent Number: 5,575,299

[45] Date of Patent: Nov. 19, 1996

[54] WALKING DEVICE

[76] Inventor: H. Carlton Bieri, 901 Cannan Dr., Angleton, Tex. 77515

[21] Appl. No.: 510,002

[22] Filed: Aug. 1, 1995

[51] Int. Cl.[6] ..... A45B 3/00

[52] U.S. Cl. ..... 135/66; 135/68

[58] Field of Search ..... 135/66–68, 84, 135/65, 69, 77

[56] References Cited

U.S. PATENT DOCUMENTS

| | | | |
|---|---|---|---|
| D. 258,096 | 3/1981 | Barford . | |
| 2,429,409 | 10/1947 | Eidman . | |
| 2,778,370 | 1/1957 | Chamblee | 135/68 |
| 3,633,967 | 1/1972 | Timmins | 135/65 X |
| 3,696,826 | 10/1972 | Gruzalski | 135/65 |
| 4,141,375 | 2/1979 | Tykwinski | 135/66 |
| 4,254,948 | 3/1981 | Jacobs | 135/68 X |
| 4,493,334 | 1/1985 | Semanchik . | |
| 4,899,771 | 2/1990 | Wilkinson | 135/84 X |
| 4,924,894 | 5/1990 | Martinez | 135/65 |
| 5,103,850 | 4/1992 | Davis . | |
| 5,287,870 | 2/1994 | Rhodes . | |
| 5,301,704 | 4/1994 | Brown | 135/84 X |
| 5,318,068 | 6/1994 | Haugen | 135/66 |

FOREIGN PATENT DOCUMENTS

| | | | |
|---|---|---|---|
| 607981 | 7/1926 | France | 135/66 |
| 2420969 | 10/1979 | France . | |
| 118989 | 6/1947 | Sweden | 135/68 |

*Primary Examiner*—Lanna Mai
*Attorney, Agent, or Firm*—Mark B. Jones

[57] ABSTRACT

A walking device which will approximate the natural walking style of a person while providing support and balance. The device is designed to be easily modified to accommodate individual different heights and body weights. The walking device has a foot member, a support member, and a body member attached to the support member opposite the foot member. The body member has means for attaching the device to the lower portion of the human leg.

6 Claims, 5 Drawing Sheets

WALKING DEVICE

FIELD OF THE INVENTION

This invention is a continuation of patent application Ser. No. 29,026,716 and relates to a walking device typically used in assisting a person who has lost or injured the lower portion of their leg.

BACKGROUND

A cane, crutch or walker is typically used in assisting a person who has injured or lost their lower leg or foot. Individuals who suffer from poor circulation in the lower extremities due to diabetes or other diseases often can not put weight on at least one foot. When walking with either a cane or crutch, the person uses the device to stabilize or balance themselves as they travel in a forward direction using their legs to achieve a forward movement. The cane or crutch is employed mainly to support the person's weight and to provide a means for assisting a person to travel. A substantial amount of balance and manual dexterity are required to use a cane or a crutch if the person can contact the ground with only one foot. In addition, since these devices only provide a small ground engaging surface, balance is difficult to maintain if the person is physically impaired. Other walking devices using three or more legs have been developed to overcome the problem with stability. If the person uses a three or four-legged walker for support, the device must be lifted as the steps are taken. While lifting the device the person is unsupported and unstable. This device is not practical for a person who only has one foot which may be allowed to contact the ground. These devices, like a cane or crutch, are not satisfactory since they impair walking action and require strength in the arms and hands. Use of all of the devices discussed previously, results in pressure on the arms and hands and may cause discomfort or be a problem to those with medical conditions such as poor circulation or arthritis.

A long standing need has existed for a walking aid which will approximate the natural walking style of a person while providing support and balance. Another need is a device which may be easily modified to accommodate individuals of different heights and body weights.

SUMMARY OF THE INVENTION

An object of this invention is to provide a walking device. A further object of the present invention is, more particularly to provide a device which will be easy to use and provide stability to a person while walking with it.

The present invention is directed to a walking device having a foot member having an upper and lower surface, a support member attached to the upper surface of the foot member, a body member attached to the support member opposite the foot member and a means for securing the body member to the human leg.

The device has the additional advantage of being able to accommodate individuals of different heights and body weights. Other advantage of the present invention will be apparent from the detailed description of the device.

BRIEF DESCRIPTION OF THE DRAWINGS OF THE INVENTION

DETAILED DESCRIPTION OF THE INVENTION

The present invention may be constructed from light weight metals such as aluminum, thin high grade steel or any suitable plastic material. The materials used must be able to support the weight of the person using the device and the stresses caused by walking while utilizing the device.

Figure 1:
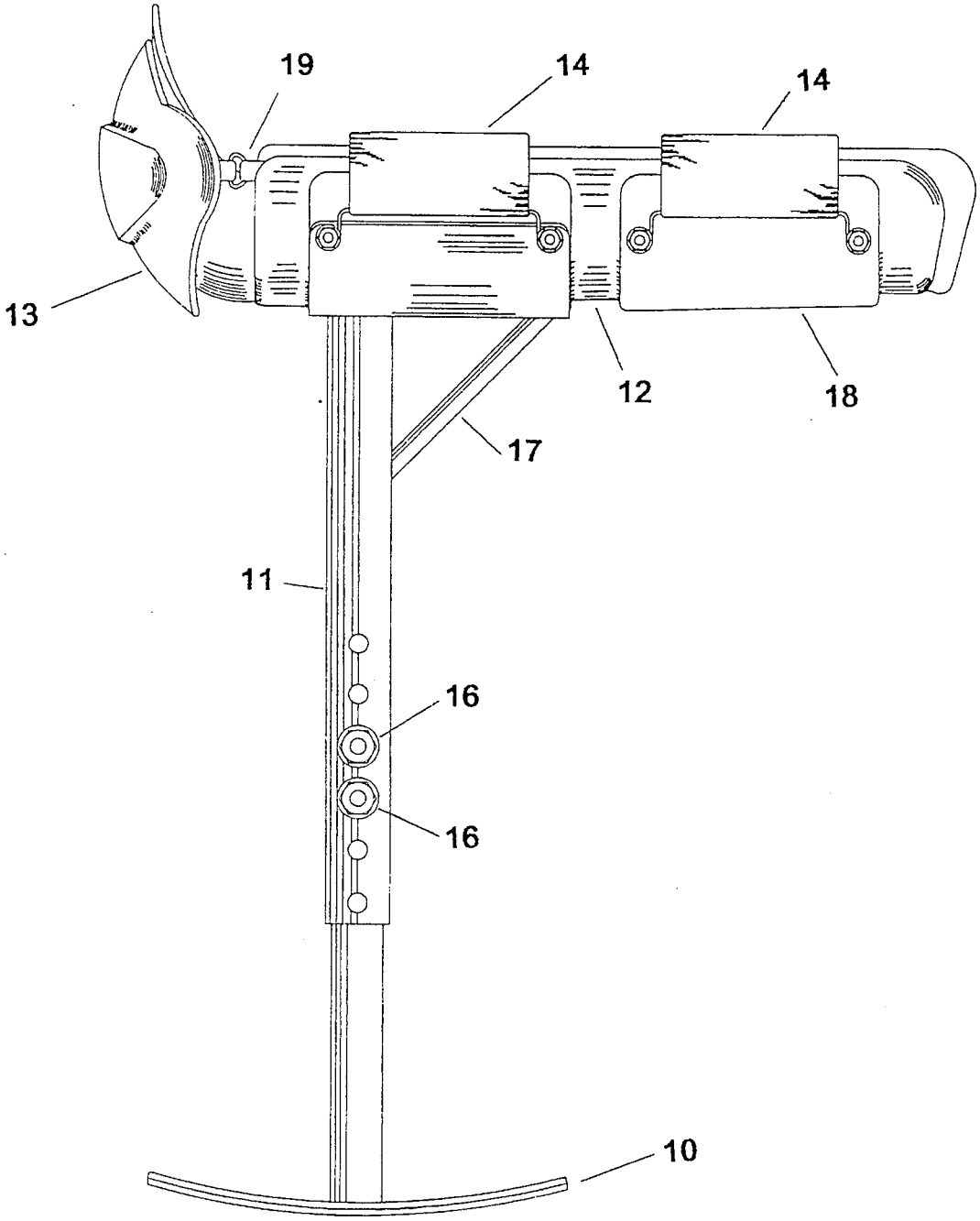
FIG. 1, is a side perspective view of the walking device constructed according to the present invention.

FIG. 1, shows a walking device that comprises a foot member 10, a support member 11 attached to the upper surface of the foot member 10, a body member 12, attached to the other end of the support member 11, a front member 13 attached to the front end of the body member 12 and an attaching 14 means, for securing the device to a human leg.

The foot member 10, may be flat or any shape but it is preferable that it be rectangular with the opposing ends curved to permit the foot member to roll in a limited manner during walking. The preferred shape being elongated or rectangular shape is shown clearly in FIG. 1, with the opposite ends of the foot member being curved upwardly. To provide traction on various surface materials, the underside of the foot member may be provided with means to prevent slipping. Patterns formed in the underside of the foot member may be used to provide a non-slip surface. It is more preferable to attach to the lower surface of the foot member various materials known in the art to provide traction to prevent skidding or slipping on various surfaces likely to be encountered by individuals using this device.

Figure 3:
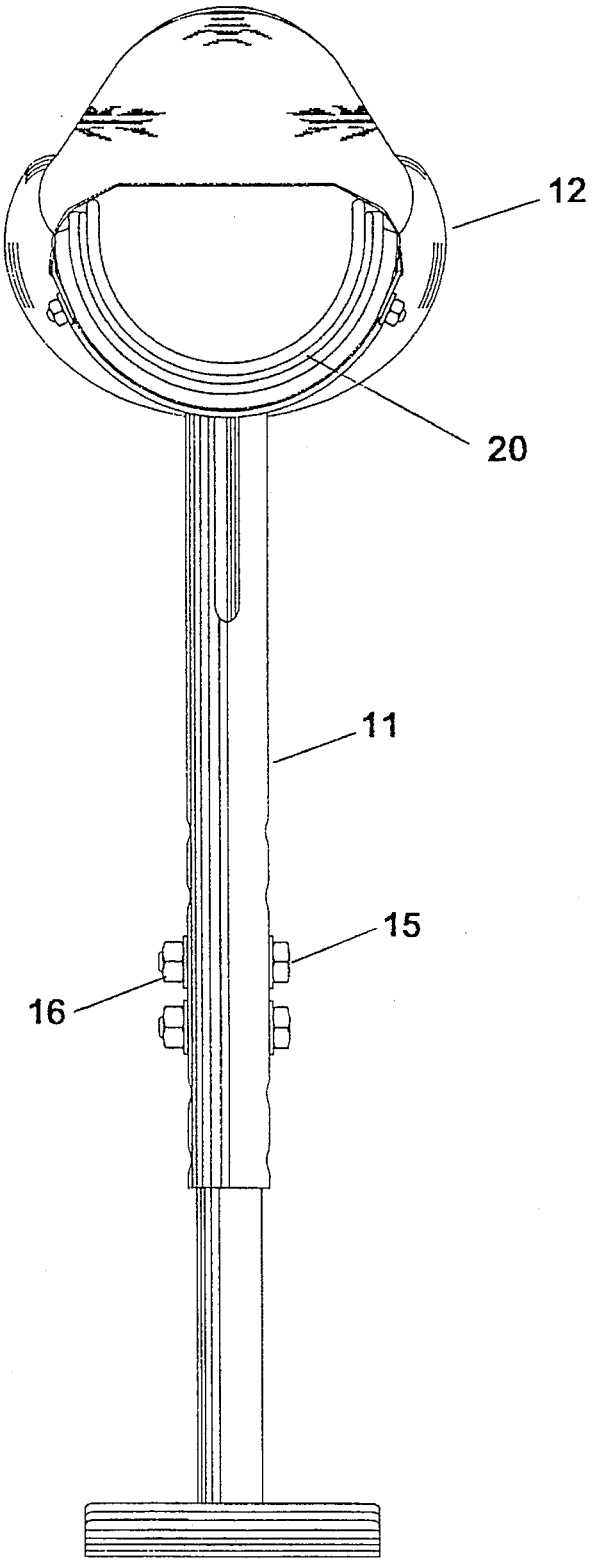
FIG. 3, is a rear perspective of the walking device shown in FIG 1, constructed according to the present invention.
Figure 4:
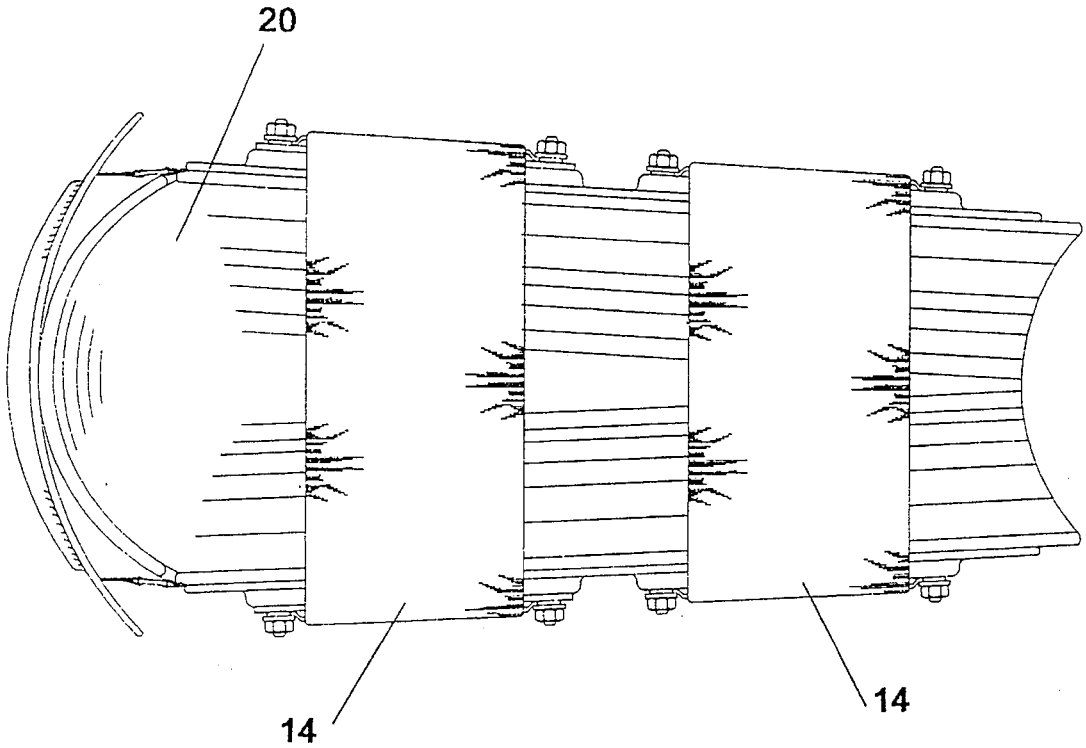
FIG. 4, is a top plan view of the walking device shown in FIG. 1.
Figure 5:
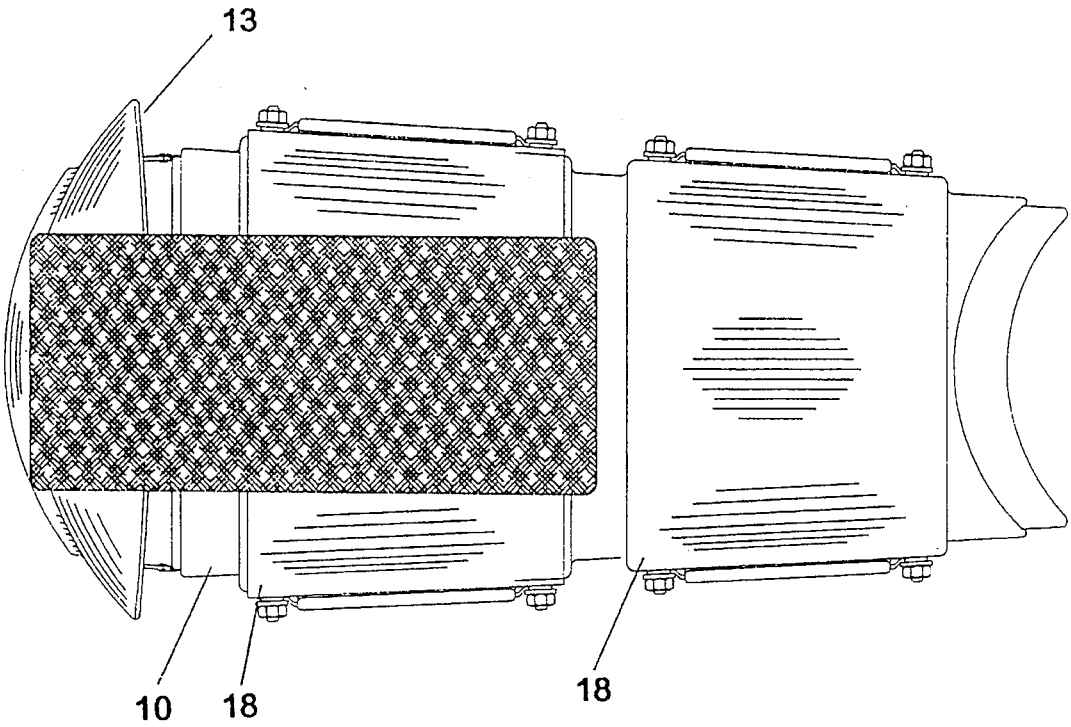
FIG. 5, is a bottom plan view of the walking device shown in FIG. 1.

Referring in detail to FIG. 3, it can be seen that the foot member is parallel to the body member. The preferred method of constructing the walking device is to slightly angle the foot member to more closely duplicate the angle that a persons foot takes in regard to their body.

Figure 2:
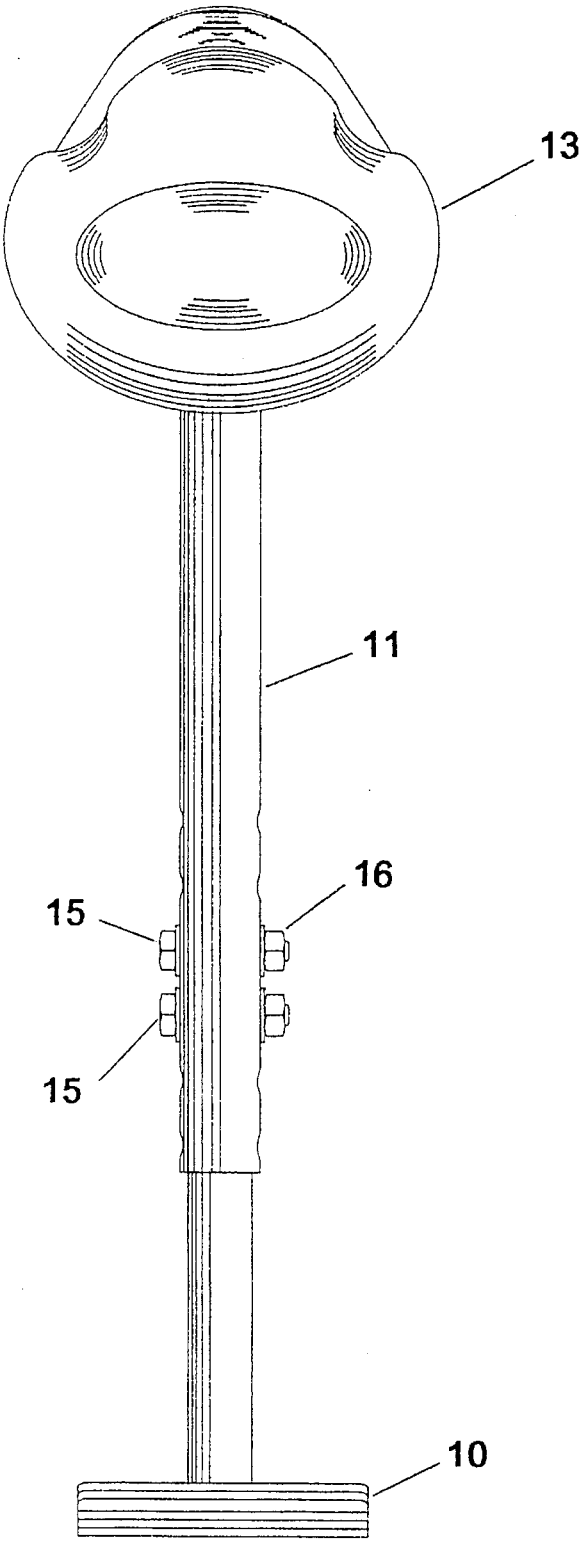
FIG. 2, is a frontal perspective view of the walking device shown in FIG. 1, constructed according to the present invention.

The support member 11, is tubular and may be of fixed length. It is preferred that the support member 11, consist of an adjustable end piece shaft which may be adjusted in length to accommodate difference in height as is shown in FIGS. 1 and 2. It is most preferable that the support member consist of at least two nested sections with one section being slideably received within the second section. The respective sections are slideably adjustable so that the length of the support member can be adjusted to the height of a given user. Means for effecting the relative adjusted position of the respective sections is taught in U.S. Pat. No. 4,493,334, which is incorporated by reference. Any other means known in the art may be used. FIG. 2 shows the use of bolts 15, secured by nuts 16, to adjust the support member.

On the end of the support member 11, opposite the foot 10, is attached a body member 12. As can be seen from FIG. 1, the body member 12, is elongated and is attached to the support member 11. In the preferred configuration, a stabilizing member 17, is used to provide an additional means of attachment to the support member 11, to reduce the flexing of the body member. In the most preferred embodiment, additional stabilizing members are used to reduce stress between the body number 12 and the support member 11. Attachment devices 18, are used to secure the attaching means 14, to the body member. The attachment devices 18, may be screws, bolts or other devices known to the art.

Means are provided for attaching the device to the lower leg portion of an individual using the attaching means 14. Thus worn an individual can then walk without putting pressure on the foot attached to the leg. The attachment may be accomplished by use of straps or other enclosures or any other means known in the art.

A front member 13, is attached to one end of the body member 12. The front member 13, is shaped to comfortably receive the human knee. In FIG. 1, the front member 13, is shown attached to the body member 12, by use of a D-ring 19. This allows the front member to move during use. In the more preferred embodiment, the body member 12 and front member 13, are constructed out of a continuous single piece of material. This embodiment alleviates the need for movement of the front member 13 and provides more strength to the walking device.

In FIG. 3, the use of cushion means 20, is shown. The cushion means 22, may consist of any type of padding which will protect the user's leg while wearing the device. In a preferred embodiment the cushion means 20, consists of a padded web support such as found in a baseball catcher's leg guard. In a more preferred embodiment, air bags or gel packs may be used to further cushion the leg. These packs have the further advantage of being adjustable to accommodate differences in a person's weight and leg shape.

I claim:

1. A walking device comprising:

a) a foot member having an upper and lower surface;

b) a support member having a first and second end, the first end of the support member attached to the upper surface of said foot member;

c) a body member having an upper and lower surface and a front and back end, the lower surface of the body member attached to the second end of said support member;

d) a front member, said front member attached to the front end of the body member; and e) an attaching means on the body member for securing the device to the human leg, said attaching means attached to the upper surface of said body member.

2. The device according to claim 1 further comprising a stabilizing member attached to the lower surface of said body member and to the support member.

3. The device according to claim 1 further comprising a cushion on the upper surface of the body member.

4. The device according to claim 1 wherein a non-skid surface is attached to the lower surface of said foot member.

5. The device according to claim 1 wherein the foot member further comprises an elongated or rectangular shape having opposing ends, said opposing ends being curved upwardly.

6. The device according to claim 1 wherein said support member includes a first and second section telescopically nested so as to render the length of said shaft readily adjustable means, means for maintaining said sections in adjustable position.

* * * * *